US010307007B2

(12) United States Patent
Thomas

(10) Patent No.: US 10,307,007 B2
(45) Date of Patent: Jun. 4, 2019

(54) ARRANGEMENT FOR DISPENSING CURTAINS

(71) Applicant: Annie Laura Thomas, Chicago, IL (US)

(72) Inventor: Annie Laura Thomas, Chicago, IL (US)

( * ) Notice: Subject to any disclaimer, the term of this patent is extended or adjusted under 35 U.S.C. 154(b) by 162 days.

(21) Appl. No.: 15/658,347

(22) Filed: Jul. 24, 2017

(65) Prior Publication Data

US 2018/0020860 A1 Jan. 25, 2018

Related U.S. Application Data

(60) Provisional application No. 62/494,041, filed on Jul. 25, 2016.

(51) Int. Cl.

| | |
|---|---|
| ***A47H 5/00*** | (2006.01) |
| ***A47H 1/08*** | (2006.01) |
| ***E06B 9/42*** | (2006.01) |
| ***A47H 15/04*** | (2006.01) |

(52) U.S. Cl.

CPC ..... *A47H 1/08* (2013.01); *A47H 15/04* (2013.01); *E06B 9/42* (2013.01)

(58) Field of Classification Search

CPC . A47H 23/00; A47H 1/08; A47H 1/04; A47H 1/00; A47H 1/022; A47H 5/00; A47H 5/02; A47H 15/04; A47H 15/00; A47H 15/02; E06B 9/42; E06B 9/17; A47K 3/38

USPC ..... 4/599, 608, 609, 610; 16/87 R, 87.2, 16/87.4 R, 88, 95 R, 95 D, 96 R, 96 D; 160/23.1, 24, 25, 26, 38, 39, 330, 327, 160/345, 123, 196.1, 208

See application file for complete search history.

(56) References Cited

U.S. PATENT DOCUMENTS

| | | | | | |
|---|---|---|---|---|---|
| 876,672 | A * | 1/1908 | Williams | A47H 1/08 | 160/333 |
| 1,028,757 | A * | 6/1912 | Margerison | A47C 19/00 | 160/108 |
| 1,363,746 | A * | 12/1920 | Nossek | E06B 9/54 | 160/21 |
| 1,713,666 | A * | 5/1929 | Lasell | A47H 19/00 | 160/108 |
| 1,878,526 | A * | 9/1932 | Kenney | A47H 1/08 | 16/87.4 R |
| 2,161,535 | A * | 6/1939 | Schwarzenbach | A47H 1/08 | 160/120 |
| 2,481,397 | A * | 9/1949 | Dalton, Jr. | A47K 3/38 | 160/31 |

(Continued)

*Primary Examiner* — Johnnie A. Shablack
(74) *Attorney, Agent, or Firm* — Fraline Allgaier

(57) ABSTRACT

The arrangement for dispensing a curtain using an extendable tube with mating rods and cartridges provides an expedient and convenient method for mounting, changing and removing curtains. It consists primarily of an extendable tube housing a cartridge for dispensing a curtain that is pre-assembled with attached circular balls and a guide piece. The cartridge is attached to mating rods that can be adjusted as needed to attach or remove additional cartridges. The user pulls the guide piece in a downward direction to release the curtain from the release chamber of the extendable tube. The circular balls spread along the sliding tracks of the extendable tube and the user can then spread the curtain as desired.

3 Claims, 6 Drawing Sheets

(56) References Cited

U.S. PATENT DOCUMENTS 2,840,827 A * 7/1958 Calvano ..... A47K 3/38 160/11
3,372,728 A * 3/1968 Schaefer ..... A47H 2/02 160/39
3,577,930 A * 5/1971 Rooklyn ..... B65G 17/20 104/103
3,879,800 A * 4/1975 Adams ..... A47H 1/08 16/96 D
4,122,559 A * 10/1978 Kelly ..... A47K 3/38 160/11
4,139,101 A * 2/1979 Towfigh ..... A47G 5/00 160/336
5,029,819 A * 7/1991 Kane ..... E01F 13/028 160/24
5,033,132 A * 7/1991 Greenblatt ..... A47K 3/38 160/123
5,333,664 A * 8/1994 Sirianni ..... A47K 3/30 160/23.1
5,421,059 A * 6/1995 Leffers, Jr. ..... A47H 1/104 16/87.4 R
6,098,699 A * 8/2000 Junius ..... A47H 13/00 16/87.2
6,276,002 B1 * 8/2001 Oschmann ..... A47H 23/01 4/558
6,648,046 B1 * 11/2003 Gibson ..... E06B 9/323 160/178.1 R
6,892,783 B1 * 5/2005 Comeau ..... A47H 1/08 160/126
6,925,681 B2 * 8/2005 Lin ..... B60J 1/2011 16/87 R
8,316,508 B2 * 11/2012 Lapping ..... E04H 15/18 135/121
2004/0237254 A1 * 12/2004 Lin ..... B60J 1/2011 16/87 R
2007/0187050 A1 * 8/2007 Jensen ..... A47H 1/022 160/196.1
2009/0255086 A1 * 10/2009 Wicker ..... A47H 5/03 16/87.8
2010/0123065 A1 * 5/2010 Pan ..... A47H 1/022 1/22
2010/0288450 A1 * 11/2010 Bruck ..... F16P 1/02 160/238
2012/0090794 A1 * 4/2012 Serio ..... A47H 1/04 160/237
2013/0167326 A1 * 7/2013 Rowan ..... A47H 1/04 16/94 D
2014/0224439 A1 * 8/2014 Graves ..... A47H 1/08 160/368.1
2016/0265275 A1 * 9/2016 Rosell Rosell ..... A47K 3/38
2017/0027362 A1 * 2/2017 Taylor ..... A47H 1/144
2017/0188739 A1 * 7/2017 Kouts ..... A47H 15/02
2017/0208981 A1 * 7/2017 Nir ..... A47H 13/00
2018/0020860 A1 * 1/2018 Thomas ..... A47H 1/08

* cited by examiner

ARRANGEMENT FOR DISPENSING CURTAINS

This application claims priority of U.S. Provisional Application Ser. No. 62/494,041 filed Jul. 25, 2016, the entire contents of which is incorporated herein by reference thereto.

BACKGROUND OF THE INVENTION

The present invention relates to an arrangement for dispensing curtains. More particularly, the present invention pertains to a curtain dispenser that enables a user to easily hang a curtain, remove a used curtain and readily dispense a new curtain from the cavity of an extendable tube.

The conventional curtain arrangements that are present in the marketplace do not provide a function where a pre-wrapped curtain with hanging elements is drawn in a downward position from the release cavity of a circular tube and with spreading means to cover a space where privacy is desired. This unique functioning of the present invention is useful for providing a quick and expedient method for mounting a curtain and subsequently dispensing a new curtain as desired. Multiple curtains can be stored individually within the extendable tube, thereby saving time and simplifying the task of changing a curtain. This invention provides for sufficient coverage in any space by easily adjusting the extendable tube.

It is a well-known custom to rinse out or wash curtains after extended use and waiting for the curtain to dry before rehanging. The inventive concept of the present invention provides for a quick removal of a used curtain and an instant replacement of a fresh and unused curtain.

The installation of curtains between adjacent walls or atypical spaces is traditionally not a simple procedure and is often time consuming. Mounting with tension rods or mounted rods often requires changing established instructions to suit the specific needs of the user. Achieving proper suspension from these rods being mounted to ceilings, window frames or the like can produce additional frustration. A user might often require additional measuring in order to ensure that the curtain is properly placed and hangs as desired. These elements combined provide for a laborious and unsafe hanging process.

The present invention helps to overcome the problems associated with hanging and replacing a curtain by providing an arrangement for dispensing curtains that is convenient to use and mainly addressing the problems of hooking and unhooking a curtain.

This new arrangement eliminates the need for hanging, hooking or laying out the curtain by providing a curtain that is held in a wrapped and pre-assembled configuration within an extendable tube. The curtain is ready to use within seconds by releasing the curtain inside a sliding rail arrangement and spreading the curtain with pre-attached circular balls. This arrangement allows a user to conveniently mount a curtain without additional steps, hooks or tooling. The extendable tube and mating rods aid the installer in positioning the arrangement to the pre-mounted end caps that are adapted to mount as suction cups on a wall surface. This feature in combination with the extendable arrangement and releasable curtains makes the invention easy to install and use.

Rehanging of a previously discharged and washed curtain is an equally expedient process. The arrangement is removed from the mounted position and a pre-filled cartridge is inserted into the extendable tube by a sliding engagement with the mating rod. The entire arrangement can be removed from the wall and transported away by compressing the extendable tube longitudinally away from the end caps.

Long-term exposure to water, dust and other elements are obvious problems for curtains hung in showers, damp areas, or places that utilize a curtain for a long-term privacy solution. These are ideal conditions for breeding germs and causes fabric deterioration, shrinkage, discoloration, molds, spotting and foul odors. This new arrangement for dispensing curtains features ventilation openings being embedded on top of the extendable tube. The ventilation openings facilitate the rapid drying of the fabric and odors are released.

This invention is especially helpful for people who suffer from chronic pain or have limited dexterity. These individuals would prefer an easy method of replacing a curtain arrangement. The mating rods are quickly removed to roll the used curtain out of the sliding rail. A new tab can be quickly released to expose and spread a new curtain.

The arrangement is low-cost, easy to manufacture, easy to assemble and provide for a quick and expedient manner for changing a curtain.

BRIEF SUMMARY OF THE INVENTION

In view of the foregoing disadvantages associated with hanging curtains, an improved arrangement for dispensing curtains is presented. As such, the general purpose of the present invention is to provide a new and improved arrangement for dispensing curtains with an extendable tube that extends between opposing walls. The extendable tube being a housing device for mating rods with proximal ends that extend inside an extendable tube, holds a plurality of cartridges and dispenses pre-assembled curtains.

Another objective of the present invention is to provide an arrangement for dispensing a curtain that is easy to install. The extendable tube and at least one pre-filled cartridge with a mating rod thereon is suctioned or releasably connected to adjacent walls. Guide tabs are used to dispense the curtain that is housed in a wrapped configuration on the cartridge. Circular balls spread along the sliding tracks of the extendable tube as the curtain is released. The user can then spread the curtain as desired.

Another object of the present invention is to provide an arrangement for dispensing curtains that makes it easy and convenient to mount a curtain. The mating rods are removed and a new cartridge is placed in the release cavity of the extendable tube. The user then uses the guide piece to release the curtain and to extend the curtain across the sliding track.

Still another objective of the present invention is to provide a curtain dispenser that has ventilation openings serving as exit points for humidity and heat within the extendable tube. They provide for the removal of heat, water and humidity from the inside of the extendable tube. This allows the curtains to dry after use or to remove any accidental spillage of water into the device.

Still another objective of the present invention is to provide a curtain dispenser that is easy to adjust and reuse in a different setting or surface arrangement. The arrangement can be shortened or lengthened by sliding the extendable tube in cooperation with the mating rods longitudinally towards or away from the outer walls of the extendable tube and the proximal ends.

Still another objective of the present invention is to provide a curtain dispenser that dispenses a plurality of pre-assembled curtains that are housed in a wrapped configuration in individual cartridges. The themed curtain can be selected as needed by the user.

Henceforth, a new and improved arrangement for dispensing curtains with an extendable tube, mating rods and cartridges is presented. This invention utilizes and combines known technologies in a new configuration in order to overcome a long felt need in the art.

Additional advantages of the invention will become apparent from the following detailed description taken in conjunction with the accompanying drawings.

DETAILED DESCRIPTION OF THE INVENTION

Figure 1:
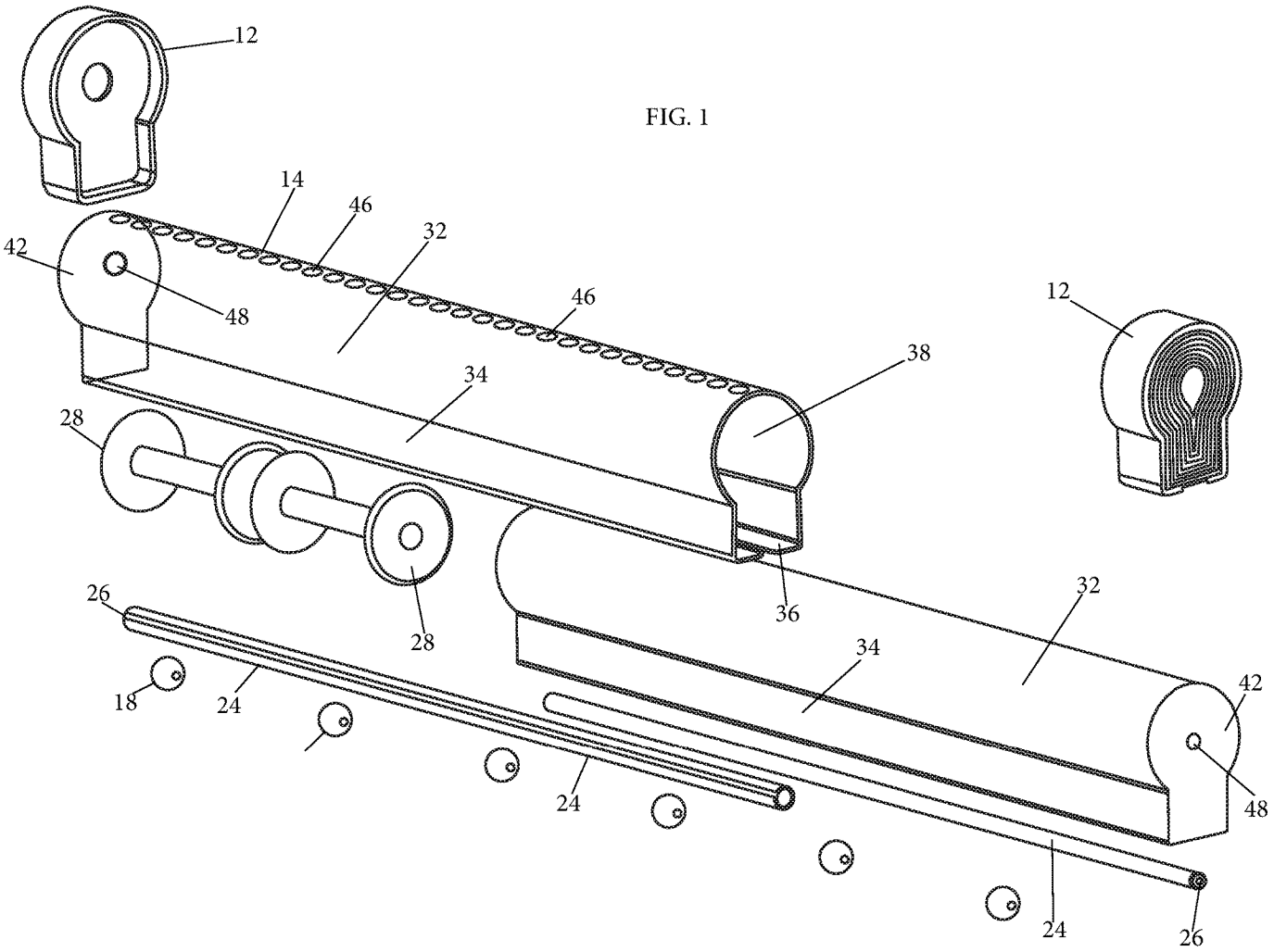
FIG. 1 is an exemplary representation of the materials needed to practice the invention as claimed herein.
Figure 2:
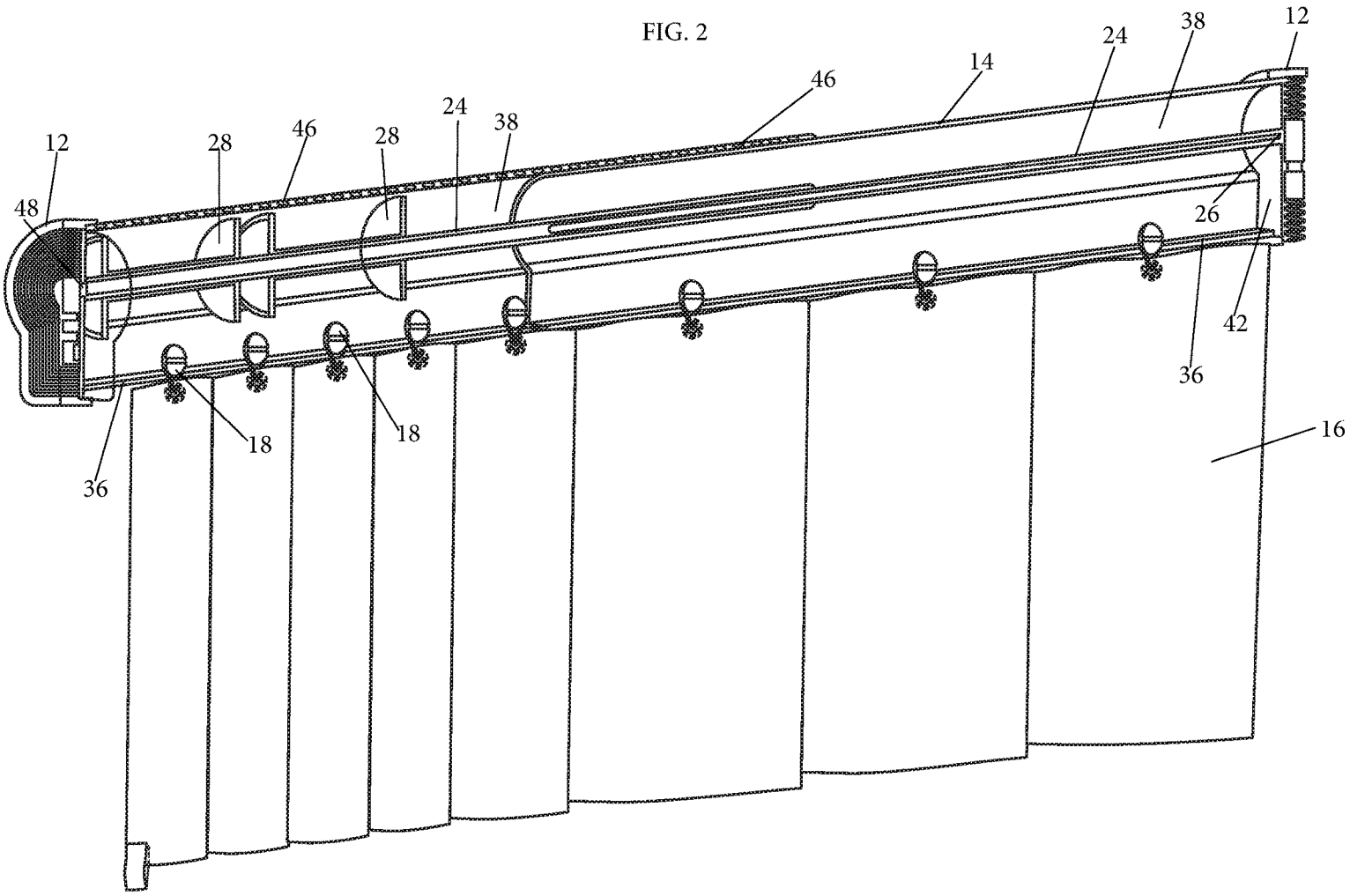
FIG. 2 is a cutaway view of the extendable tube.
Figure 3:
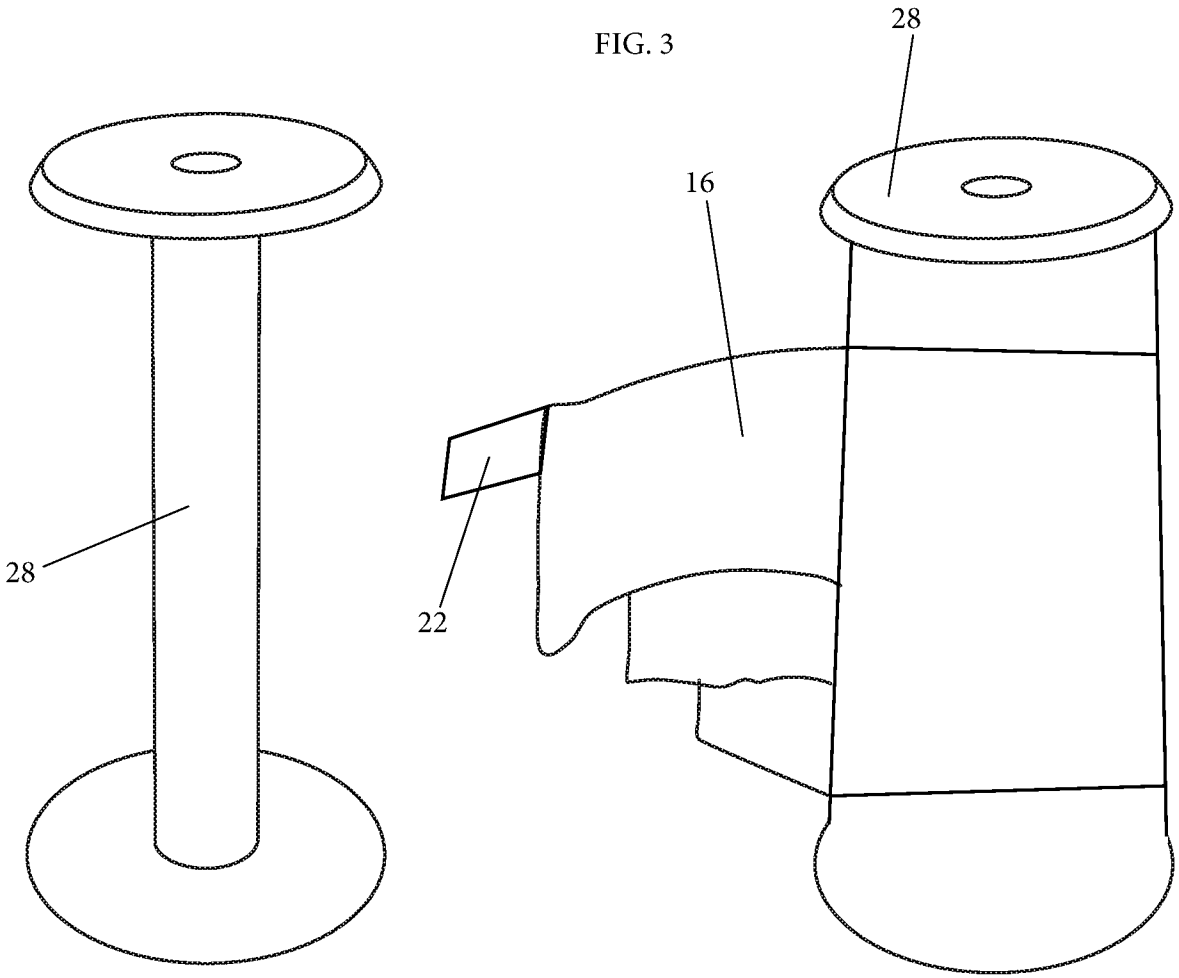
FIG. 3 is a perspective view of a plurality of cartridges.

The present invention derives from the long-standing recognition that the tradition of installing and removing curtains is a time-consuming and laborious process. The present invention provides advantageous features for an arrangement of dispensing curtains and provides relief for users who desire a quick and easy installation or removal of a curtain. The arrangement employs an adjustable device that is easy to install and is adjusted based on the user's need to dispense, remove or rehang a curtain.

Turning now to FIGS. 1-6 of the attached drawings, the invention employs an arrangement 10 for dispensing a curtain 16 between adjacent surfaces with end caps 12 being mounted on each end of the arrangement 10. An extendable tube 14 is used for dispensing a curtain 16 with attached circular balls 18 and a guide piece 22 that extend between opposing surfaces. The extendable tube 14 is a housing device for mating rods 24 with proximal ends 26 that extend inside the extendable tube 14 and a plurality of cartridges 28 for dispensing the curtain 16 that is housed in a wrapped configuration in the cartridge 28.

The extendable tube 14 has a top section 32, a bottom section 34, a sliding track 36, a release cavity 38, outer walls 42, end caps 12 and ventilation openings 46. The top section 32 of the extendable tube 14 has a generally circular interior. The end caps 12 are releasably connected to the outer walls 42 of the extendable tube 14 and the sliding track 36 is attached to the bottom section 34 of the extendable tube. The sliding track 36 has a generally rectangular configuration and is aligned in a parallel configuration to the top section 32 of the extendable tube 14. The release cavity 38 provides for the quick release of the circular balls 18 into the sliding track 36 and the spreading of the curtain 16 through the sliding track 36. The outer walls 42 of the extendable tube have circular openings 48 for receiving the mating rods 24. The outer walls 42 function as receiving elements for the mating rods 24. The mating rods 24 can be connected to said circular openings by screwing, force fitting, extension towards said end caps 12, and by utilizing additional methods of connecting a rod to a vertical plane.

The ventilation openings 46 are exit points for humidity and heat within the extendable tube 14. They provide for the removal of heat, water and humidity from the inside of the extendable tube 14 and allow the curtains to dry after use. The ventilation openings 46 provide positive pressure ventilation when used in tandem with the existing openings along the sliding track 36.

The mating rods 24 extend through said cartridges 28 and allow for their independent rotation. The mating rods 24 are in parallel configuration with the extendable tube 14. The cartridges 28 are loosely held within the extendable tube 14 and are held in parallel configuration with the extendable tube 14 and the mating rods 24. The mating rods 24 and the cartridges 28 do not collide with the release cavity 38 or other areas of the extendable tube 14. The cartridges 28 conform to the general shape of the release cavity 38 and prevent entanglement or of the curtain 16 during storage and while extracting the curtain 16 therefrom.

The curtain 16 has circular balls 18 and a guide piece 22 that is attached thereon. For dispensing purposes, the guide piece 22 can be tongues, ropes, pins, ties, studs or any similar guide to aid in the removal of the curtain 16. The curtain 16 is sufficiently sized to easily pull away from the cartridge 28 when the guide piece 22 is pulled. The curtain 16 is released by slightly pulling the guide piece 22 until the curtain 16 travels downwardly through the sliding track 36. The sliding track 36 catches and supports the circular balls 18 once the curtain 16 is released and thereby causing the circular balls 18 to spread within the sliding track 36.

The arrangement 10 can be shortened or lengthened by sliding the extendable tube 14 and the mating rods 24 longitudinally towards or away from the outer walls 42 of the extendable tube 14.

Figure 4:
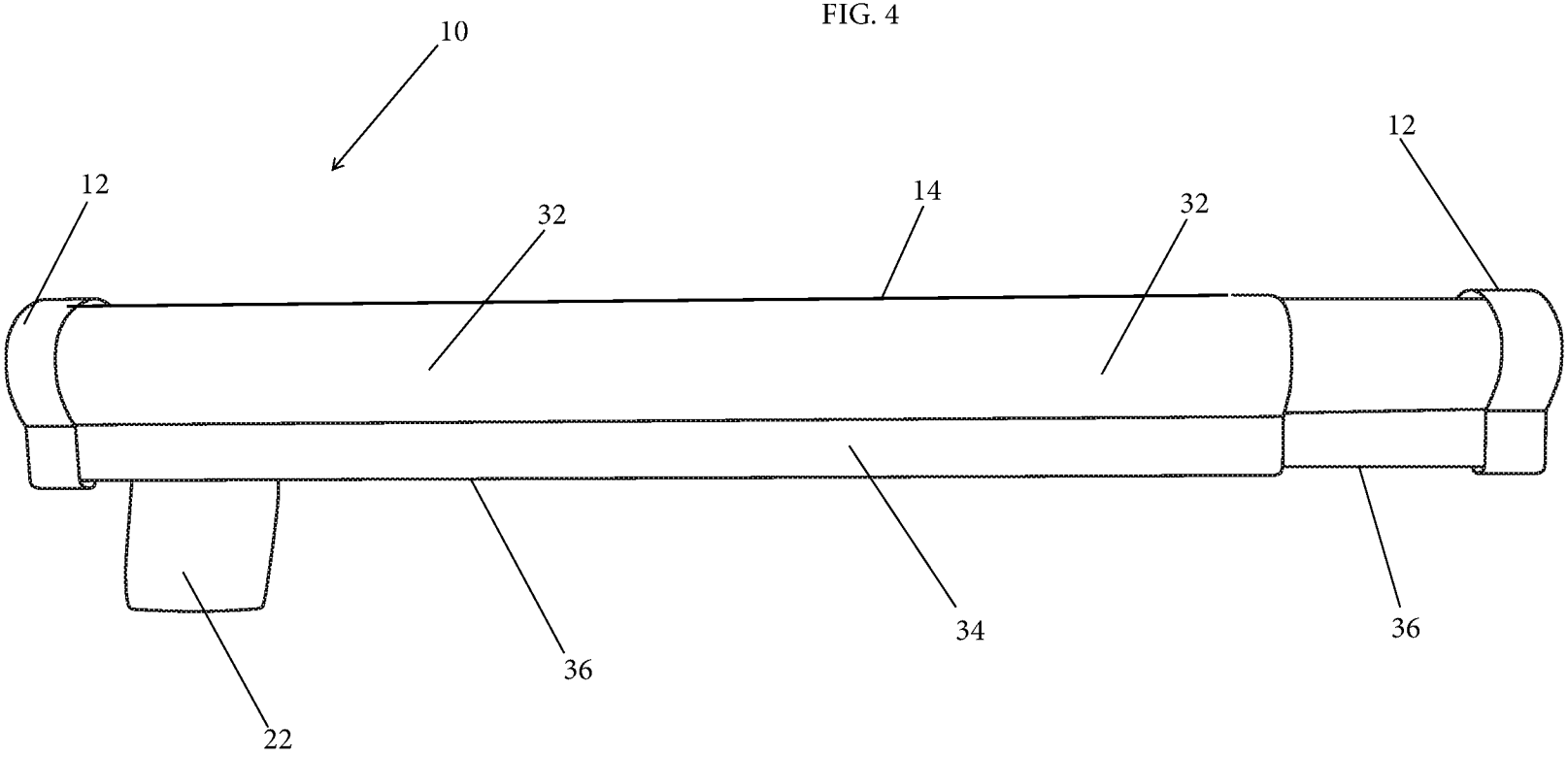
FIG. 4 is a perspective view of an extendable tube with a guide piece being exposed.
Figure 5:
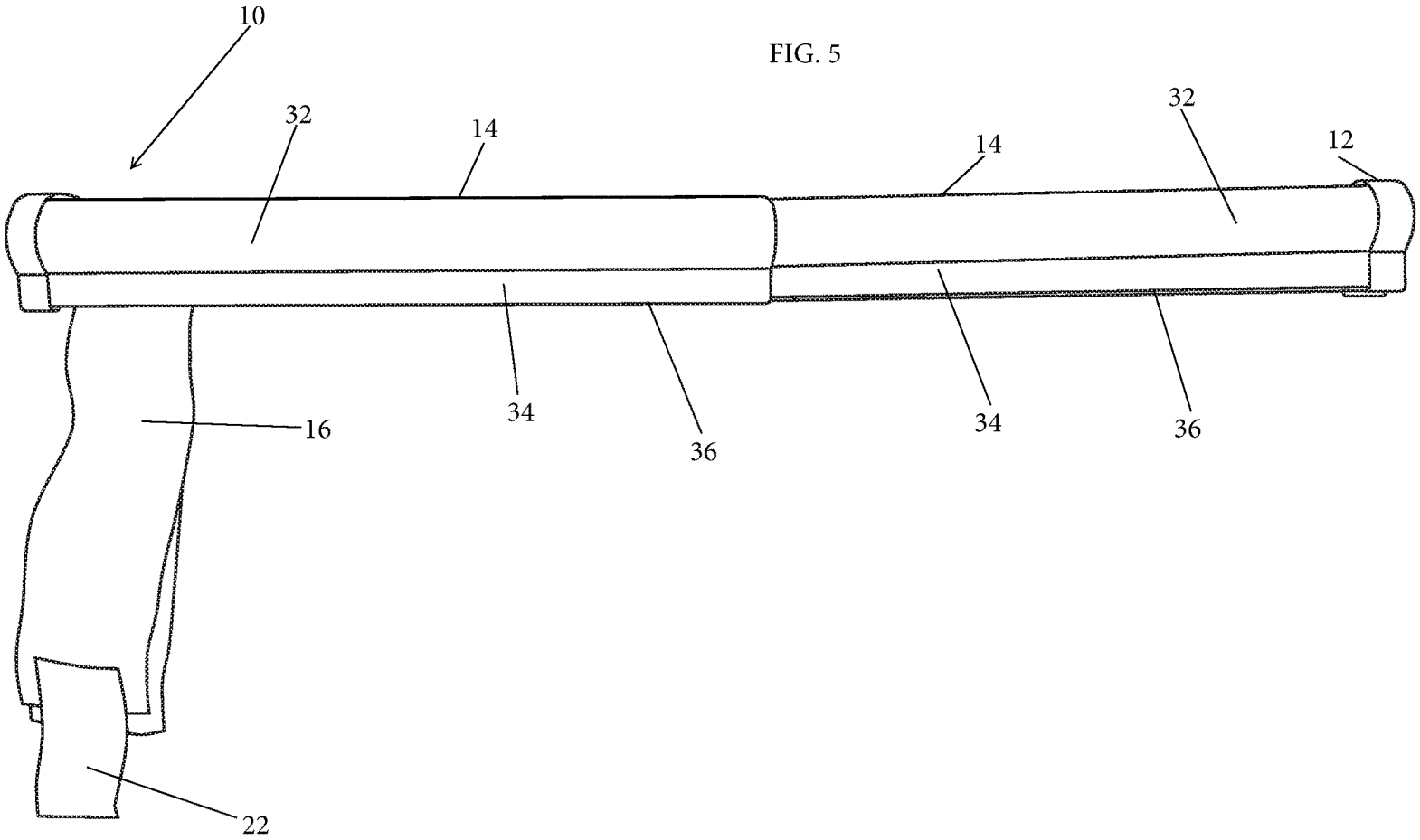
FIG. 5 is a perspective view of an extendable tube with a wrapped curtain being extended.
Figure 6:
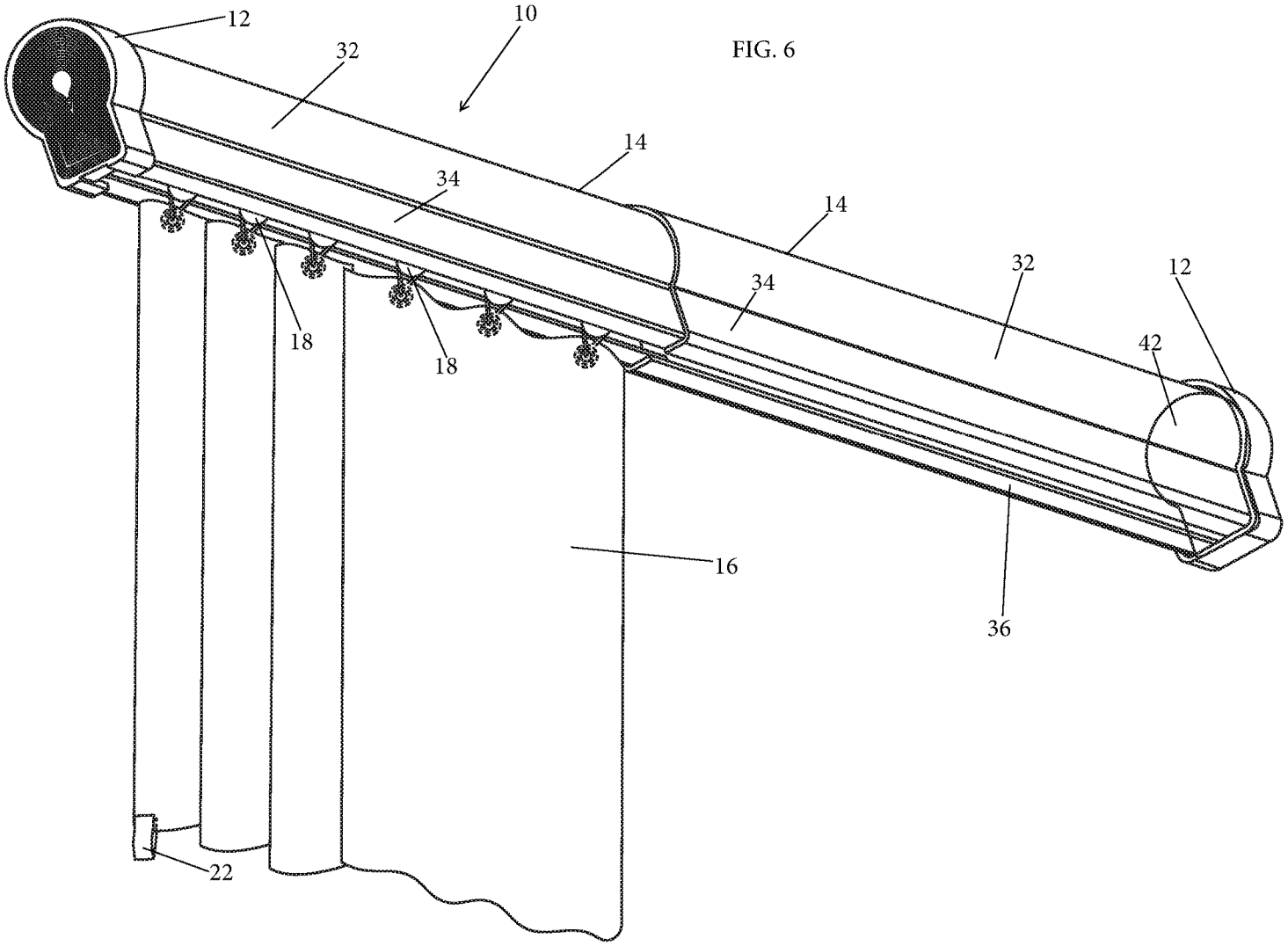
FIG. 6 is a perspective view of an extendable tube with a curtain being extended along a sliding track.

As shown in FIGS. 4 and 5, the curtain 16 is dispensed as the guide piece 22 is drawn downwardly. The guide piece 22 is then used to extend the curtain 16 across the sliding track 36. The cartridge 28 rolls around the mating rods 24 and is prevented from dropping into the release cavity 38 as the curtain 16 is drawn downwardly and moved across the sliding track 36.

The arrangement 10 can hold a plurality of cartridges 28 and is adapted to dispense a plurality of themed curtains 16 that can be selected as needed based on the celebratory needs of the user. The themes can include Halloween, religious celebrations, Thanksgiving, birthdays, university emblems, patriotic symbols and various other types of celebratory or decorative themes.

Manufacturing of the arrangement 10 and in particular both the extendable tube 14 and the mating rods 24 can be simplified by making these elements the same length. The cartridge 28 can be constructed in various sizes and utilize additional retaining elements to facilitate a quick release of the curtains 16 and prevent entanglement of the curtain 16 when not in use. The extendable tube 14, mating rods 24 and circular balls 18 of the present invention may be constructed from stainless steel, molded plastic, iron, plated brass, or any other rigid material. Thermoplastic synthetic materials would also provide a smoother surface to allow the frictionless movement of the cartridges 28, circular balls 18, and mating rods 24. The material used to produce the curtain will depend on the use of the arrangement. For example, wrinkle free fabrics can be used to dispense curtains in a formal setting while a plastic material could be used in a shower.

Various types of fabrics can be used to manufacture the curtains 16. These include netting fabrics, silk, wool, flax, hemp, cotton, plastic, woven and non-woven fabrics, knitted fabrics, technical fabrics (such as Gore-Tex® and Gannex®)

and fabrics consisting of natural or artificial fibers. This invention can be used as curtains 16 in an open room arrangement, window box coverings, showers, dormitories, hotels, hospitals, and nursing homes, airplanes or as a hanging arrangement in any location where privacy is desired.

Although a specific embodiment of the invention has been shown to illustrate the principles of the invention, it should be clear that many modifications can be made that do not depart from these principles and therefore this invention should be limited only by the spirit and scope of the following claims.

What is claimed is:

1. An arrangement for dispensing a curtain, said arrangement comprising:

a. a curtain between adjacent surfaces with end caps being mounted on each end of said arrangement, b. an extendable tube configured to dispense said curtain, said extendable tube being a housing device, said housing device housing mating rods with proximal ends that extend inside said extendable tube and a plurality of cartridges, said curtain being housed in a wrapped configuration on one cartridge of said plurality of cartridges, c. said extendable tube having a top section, a bottom section, a sliding track, a release cavity, outer walls, said end caps and ventilation openings; said top section of said extendable tube having a generally circular contour; said end caps being releasably connected to said outer walls of said extendable tube; said sliding track being attached to said bottom section of said extendable tube, said sliding track having a generally rectangular configuration and being aligned in a parallel configuration to said top section of said extendable tube; said outer walls having circular openings for receiving said mating rods, said outer walls receiving said mating rods in said outer wall, said ventilation openings being exit points for humidity and heat within said extendable tube, d. said mating rods extending through said cartridges and allowing independent rotation of said cartridges, said mating rods being in parallel configuration with said extendable tube, e. said cartridges being loosely held within said extendable tube and being held in parallel configuration with said extendable tube and said mating rods, f. said curtain having circular balls and a guide piece attached thereon, said curtain configured to unwrap from said cartridge when said guide piece is pulled, said curtain configured to release from said cartridge by pulling said guide piece until said curtain travels downwardly through an opening in said sliding track, said sliding track configured to catch and support said circular balls once said curtain is released, said circular balls spread within said sliding track, and said circular balls remaining within said sliding track.

2. The arrangement for dispensing a curtain of claim 1 wherein a plurality of curtains are provided on respective cartridges of said plurality of cartridges.

3. The arrangement for dispensing a curtain of claim 1 wherein said curtain has balls of different sizes and shapes.

* * * * *